United States Patent [19]

McIntosh et al.

[11] 4,323,047

[45] Apr. 6, 1982

[54] AUTOMATIC BALL PITCHING MACHINE

[75] Inventors: James K. McIntosh, Somerset, N.J.; M. Numata, Tokyo, Japan

[73] Assignee: Carolina Enterprises, Inc., New York, N.Y.

[21] Appl. No.: 102,651

[22] Filed: Dec. 12, 1979

[51] Int. Cl.[3] ..... F41B 15/00

[52] U.S. Cl. ..... 124/1; 124/81; 124/50

[58] Field of Search ..... 124/10, 6, 78, 79, 41 R, 124/49, 81, 1, 50; 273/29 R, 29 A, 26 D

[56] References Cited

U.S. PATENT DOCUMENTS

| | | | |
|---|---|---|---|
| 1,356,466 | 10/1920 | Parsons | 124/6 |
| 2,700,379 | 1/1955 | Brigati | 124/5 X |
| 4,080,950 | 3/1978 | Paulson et al. | 124/1 |
| 4,197,827 | 4/1980 | Smith | 124/78 |

*Primary Examiner*—Richard C. Pinkham
*Assistant Examiner*—William R. Browne
*Attorney, Agent, or Firm*—Kirschstein, Kirschstein, Ottinger & Cobrin

[57] ABSTRACT

An apparatus for expelling baseballs or other game balls with a considerable backspin. In the usual case, where the game ball is shot out generally parallel to the ground, the ball trajectory starts out relatively straight due to the rather large expulsion force, and thereupon when the expulsion force is almost spent, the backspin takes over, and the game ball will suddenly rise above the ground. This simulates a real life baseball pitcher whose fast ball has a "live hop". The apparatus features a rotating flywheel with an upper guide chute, in which is disposed a rubber pad to provide a constriction of lesser dimension than the diameter of the game ball, so that the game ball when fed onto the flywheel is passed through the guide chute, for subsequent expulsion in a generally linear, e.g. horizontal, trajectory, but with subsequent upward movement due to the backspin which is caused by the game ball passing through the constriction.

16 Claims, 7 Drawing Figures

AUTOMATIC BALL PITCHING MACHINE

BACKGROUND OF THE INVENTION

1. Field of the Invention

An apparatus for propelling spherical game balls sequentially with a backspin, so that the trajectory of the motion of the expelled game balls includes a terminal upward rise.

2. Description of the Prior Art

Pitching machines which shoot out baseballs or other game balls have been known for many years; their popularity and development was predicated on the popularity of and consumer interest in the game of basball itself, especially major league professional baseball. One major feature of some of these prior art pitching machines is that the pitching machine shoots out baseballs with a considerable backspin. The ball trajectory starts out relatively straight due to the force of expulsion, and thereupon the backspin takes over, and the ball with suddenly rise from the ground. This simulates the real life baseball pitcher whose fast ball has a "live hop".

Among the prior art relative to such pitching machines may be mentioned U.S. Pat. Nos. 4,080,950; 3,915,143; 3,779,227; 3,306,613; 2,729,206; 2,716,973; 2,391,636; 2,112,611; 1,211,738; 1,201,626; 1,198,359 and 1,196,741.

SUMMARY OF THE INVENTION

1. Purposes of the Invention

It is an object of the present invention to provide an improved automatic ball pitching machine.

Another object is to provide an improved apparatus for propelling and expelling spherical game balls sequentially.

A further object is to provide an improved pitching machine for shooting out game balls with a backspin.

An additional object is to provide a simulation of a real life baseball pitcher throwing a fast-ball with a "live hop".

Still another object is to provide fun and amusement for young and old alike who are interested in baseball and like sports using a spherical game ball.

Still a further object is to provide an inexpensive, sturdy, reliable and smooth-working automatic ball pitching machine which may be readily produced in mass-production facilities using unskilled labor.

These and other objects and advantages of the present invention will become evident from the description which follows.

2. Brief Description of the Invention

In the present invention, briefly summarized, game balls pass down a loaded feed chute provided with sequential feed, and each game ball in turn engages a flywheel. The ball is thrown against a brake, the flywheel and the brake having soft rubber surfaces, and the ball is squeezed between the brake and the flywheel. The top of the ball is temporarily held back by the brake, while the bottom of the ball is spun by the flywheel. The ball is then hurled out and expelled with a reverse spin or backspin, the backspin giving a rise to the ball trajectory. This simulates a rising fast ball as thrown by baseball pitchers and others.

Thus, the present invention basically entails the provision of an apparatus for propelling spherical game balls sequentially which includes an inclined gravity feed loading chute; means to load game balls into said loading chute, either by hand or using a funnel feed or the like; a flywheel adjacent the lower end of the loading chute, which flywheel has a flexible and resiliently deformable outer surface on its circumference; means to rotate the flywheel at high speed; a ball release assembly adjacent the lower end of the loading chute, to feed the game balls sequentially to the flywheel; a generally cylindrical or frusto-conical guide chute mounted above the flywheel, so that the spherical game balls are passed sequentially by the rotating flywheel into the guide chute; and, a stationary, flexible and resiliently deformable brake pad.

The brake pad is mounted in the guide chute above the flywheel and spaced from the flywheel at a distance less than the diameter of the game balls. Thus, a constriction which is capable of yielding is provided in the path of travel of the game balls in the guide chute. Each game ball released by the ball release assembly from the loading chute first engages the rotating flywheel, which moves the game ball against the brake pad. The pad temporarily holds fast the top of the game ball, while the bottom of the game ball is in contact with the rotating flywheel. The flywheel pulls the game ball past the constriction, by squeezing the flexible and resiliently deformable pad and flywheel surface, so that once free of the constriction, the flywheel throws, i.e. propels or expels, the game ball out of the guide chute and concomitantly imparts a backspin on the game ball due to the friction generated at the constriction. The backspin is of an opposite sense of rotation to that of the flywheel. Typically, the flywheel rotates clockwise, so that the backspin imparted to the game ball is counterclockwise and the ball rises towards the end of its trajectory. Alternatively, the flywheel may rotate counterclockwise, in which case the backspin imparted to the game ball will be clockwise and the ball will sink towards the end of its trajectory.

The game ball may be any suitable spherical ball, such as a real or simulated baseball, handball, soccer ball, softball, hollow or solid rubber ball, tennis ball, golf ball, etc.

With regard to the details of the structural mechanism of the invention, the ball release assembly typically is a pivoted timing arm which is pivoted at regular intervals by a drive cam. The brake pad will usually have a curved or rounded surface to facilitate entry and exit of the ball. The angle of inclination of the guide chute relative to the horizontal is typically adjustable about a pivoted support; in this case, generally, the angle may be adjustable from zero to 90° straight up vertically or some smaller acute below the horizontal. In a preferred embodiment, the angle of inclination of the guide chute is adjusted by a linear rack and pinion gearing. The rack is attached to the guide chute and has a circular curvature about a center axis coincident with the pivoted or pivotal axis of the guide chute. Means such as a knob shafted to the pinion gear is provided to partially or fully rotate the pinion gear thus pivoting the rack and integral guide chute combination.

The flexible and resiliently deformable elements, i.e. the brake pad and outer surface of the flywheel, are typically each composed of natural or synthetic rubber, or plastic. In the case of synthetic rubber, neoprene or buna is preferred. In the case of plastic, numerous plastics such as certain forms of polyvinyl chloride, polyethylene, polypropylene or a polyurethane may be employed.

Typically, the brake pad has an abutment portion which extends into the path of travel of the game balls to form a constriction, together with an upstream flared portion which diverges outwardly from the abutment portion in upstream direction, to facilitate presentation of each game ball to the abutment portion. In addition, the brake pad usually has a downstream tapered portion which diverges outwardly from the abutment portion in downstream direction, to facilitate expulsion of each game ball away from the abutment portion so theat each game ball is propelled into the downstream portion of the guide chute and expelled from the device.

Usually, means will be provided for detachably and interchangeably mounting the brake pad on the inner surface of the guide chute. The interchangeably mounting means for the brake pad will generally be accessible from the exterior of the guide chute, so as to permit ready access thereto, for exchanging a used or worn pad for a fresh one.

The flywheel typically has a generally circular core portion, and an outer flexible and resiliently deformable layer portion. The layer portion circumferentially surrounds the core portion, the core portion being of greater mass and weight than the outer layer portion so as to provide greater momentum to the flywheel thus stabilizing its motion against intermittent slowdown as each game ball is passed through the guide chute and in contact with the brake pad.

Generally, the outer surface of the flywheel is concave, i.e. the outer surface has a shallow circumferential centering trough for receivably guiding each game ball in a predetermined controlled manner along the travel path and especially into and through the guide chute.

Finally, in most cases, the motor or other means to rotate the flywheel also drives the ball release assembly, typically by means of step down gearing.

The present automatic ball pitching machine provides several salient advantages. The device is fun to play with and provides amusement for young and old alike who are interested in the sport of baseball or other games and sports using a moving spherical ball. The device simulates a real baseball game by expelling the baseballs with a considerable backspin; thus when the ball is shot out generally horizontally, there is a real "live hop" to the ball analogous to a baseball pitcher's fast ball which suddenly rises above the ground as it passes over home plate and the batting area. Thus the device propels and expels spherical game balls sequentially with a spin or twist so that a person can improve his or her batting skill using the device. The present device is inexpensive, sturdy, reliable and smooth-working, and may be readily produced in mass-production facilities using unskilled labor. Thus, an improved apparatus has been provided for propelling spherical game balls sequentially with a backspin, so that the trajectory of the motion of the expelled game balls includes a terminal upward rise (or a downwards sink or fall).

The invention accordingly consists in the features of construction, combination of elements, and arrangement of parts which will be exemplified in the device hereinafter described, and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
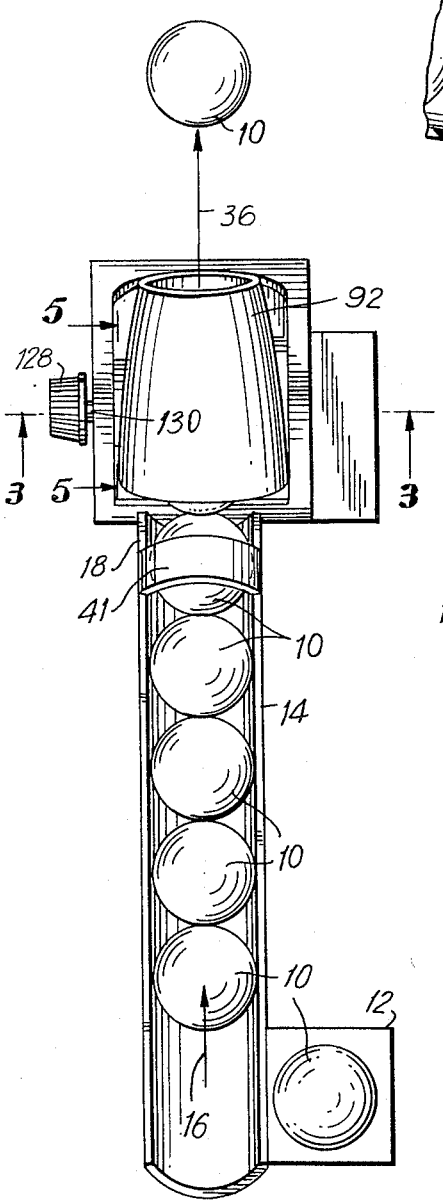
FIG. 1 is an overall plan view of the device.

Referring now to the Figures, spherical game balls 10 are fed by a means 12, which may be a funnel, a box or other enclosure, into an inclined gravity-feed loading chute 14. The balls 10 pass sequentially down the chute 14 in the direction indicated by the arrow 16, and each ball in turn reaches the lower end 18 of the chute 14, where a ball release assembly is located to feed the balls 10 sequentially to a flywheel 20. The ball release assembly in this embodiment of the invention basically consists of a timing arm 22 having terminal projections 24 and 26 which alternately extend upwards through lower openings in the loading chute 10 adjacent its lower end 18, so as to controllably release each ball 10 sequentially for passage to the flywheel 20.

Figure 2A:
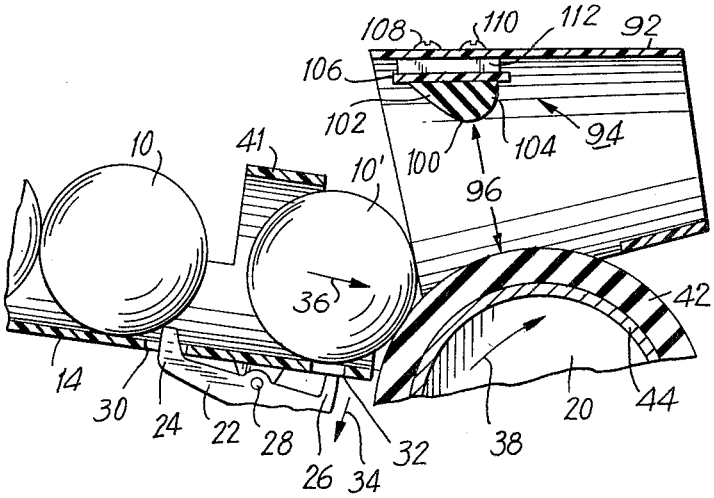
FIGS. 2A, 2B and 2C are partial sectional elevation views showing the progression of a game ball through the device.

Thus, FIG. 2A shows the timing arm 22, which is centrally pivoted at 28, in a disposition wherein a ball 10 is being held by the upwardly extending projection 24, which extends through an opening 30 in the bottom of loading chute 14, while a lower ball 10' is free to pass in contact with the flywheel 20 since the projection 26 is below and out of a lower opening 32 in the bottom of loading chute 14. The timing arm 22 in this case has been pivoted about pivot 28 in the direction of arrow 34, and the ball 10' moves as shown by arrow 36 under the influence of gravity to contact with the rotating flywheel 20, which is rotating clockwise as indicated by arrow 38.

Figure 2B:
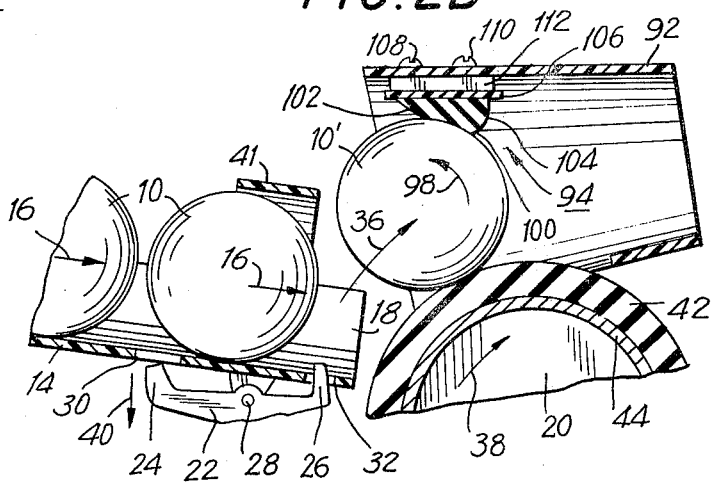
Figure 2C:
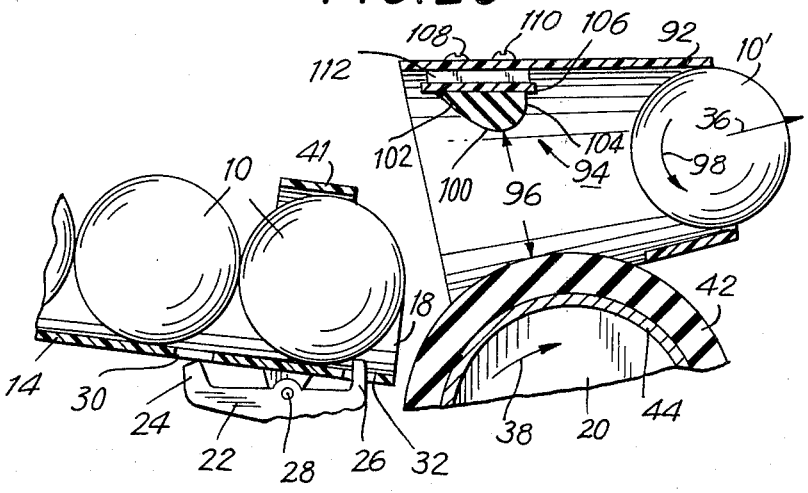

FIG. 2B shows, inter alia, the timing arm 22 pivoting in the opposite sense as shown by arrow 40, so that projection 26 now extends through opening 32, and as seen in FIG. 2C, the next succeeding ball 10 is temporarily held in the lower end 18 of the chute 14 by the projection 26. Thus, in essence the timing arm 22 rocks back and forth about pivot point 28, to sequentially feed the game balls 10 to the flywheel 20.

Figures 4, 5:
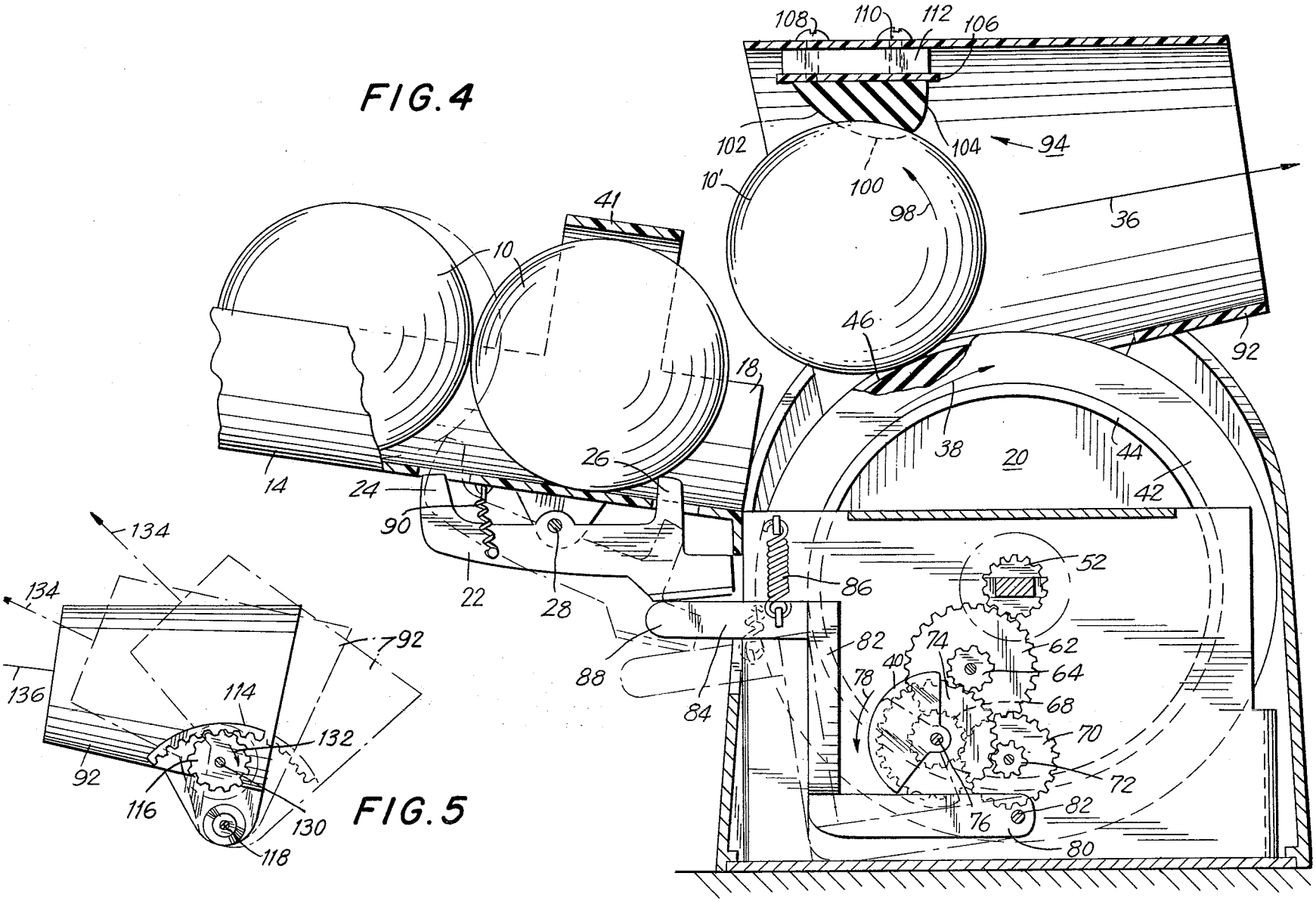
FIG. 4 is a sectional elevation view taken substantially along the line 4—4 of FIG. 3 and showing further internals and parts of the device.
FIG. 5 is a partial sectional elevation view taken substantially along the line 5—5 of FIG. 1 and showing the mode of manipulation and various positions of the guide chute.

As best seen in FIG. 4 and as will appear infra, the timing arm 22 is pivoted at regular intervals by a drive cam 40. At the lower end 18 of the loading chute 14, a transverse upper guidebaffle 41 extends across the top of the loading chute 14, so that the flywheel 20 cannot force game ball 10' upwards and out of the device before the game ball 10' passes into the guide chute to be described infra.

Figure 3:
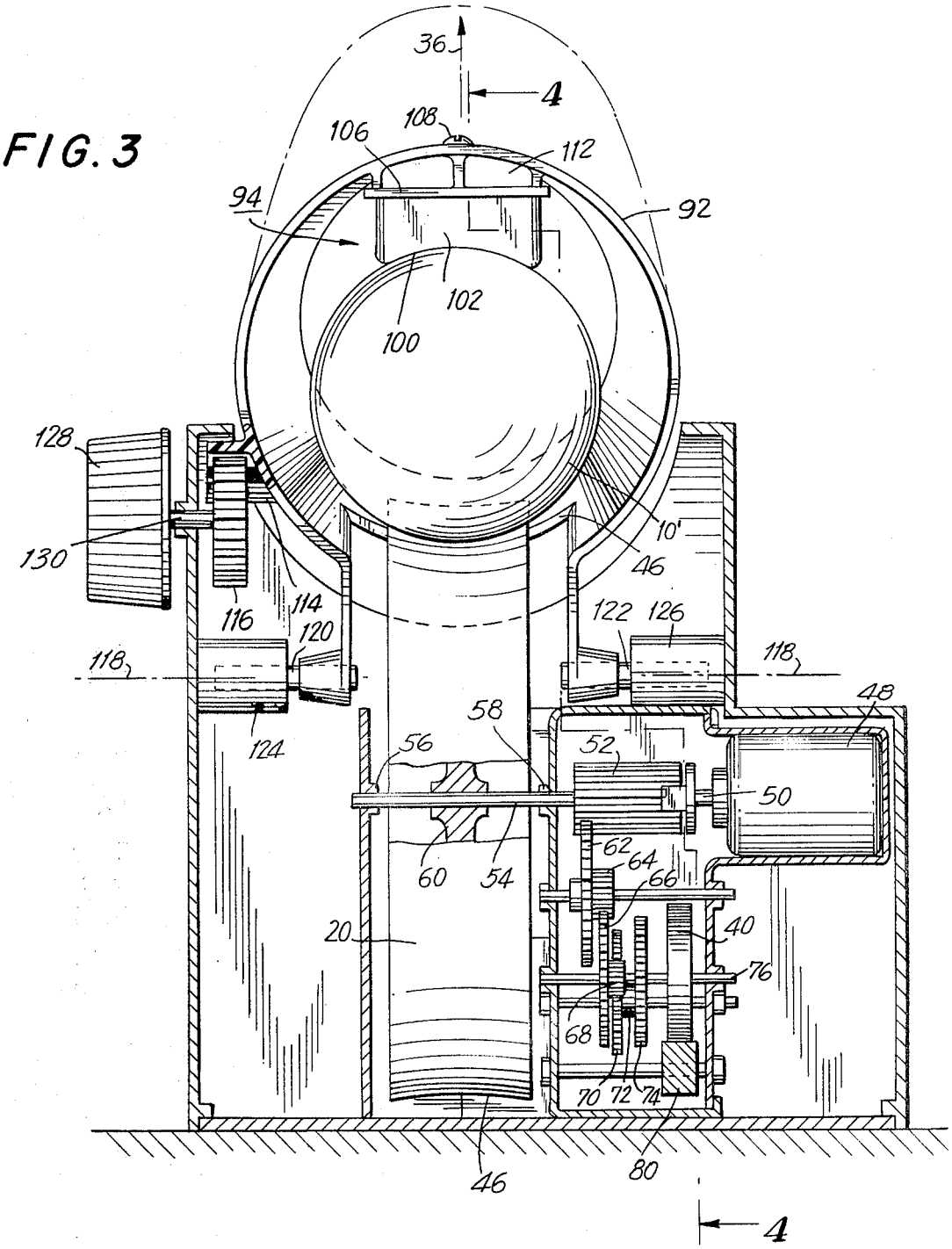
FIG. 3 is a sectional elevation view taken substantially along the line 3—3 of FIG. 1, and showing internals of the device.

The flywheel 20 is characterized by the provision of a flexible and resiliently deformable outer surface on its circumference, which outer surface generally consists of an outer circular layer 42 which may be composed of natural or synthetic rubber, e.g. neoprene or Buna, or a feasible type of plastic, e.g. polyvinyl chloride, polyethylene, polypropylene, or polyurethane. The outer circular layer 42, as best seen in FIGS. 2 and 5, is an outer flexible and resiliently deformable layer portion which circumferentially surrounds an inner core portion 44, with the core portion 44 generally being of greater mass and weight than the outer layer portion 42. In addition, as best seen in FIG. 3, the outer surface of the flywheel 20 is concave and has a shallow circumferential centering trough 46 for receivably guiding each game ball 10 along the travel path after discharge from the loading chute 14. The flywheel 20 is rotated at high speed, e.g. at least about 120 revolutions per minute, by a motor 48 (FIG. 3) which is connected by a driveshaft 50 to a gear 52 (for reasons which will appear infra) which gear 52 is axially integral with driveshaft 54 mounted on journals 56 and 58. The driveshaft 54 is also mounted to a central hub 60 of the flywheel 20, so that as the shaft 50 of the motor 48 rotates, a concomitant rotation of main gear 52, shaft 54, hub 60 and flywheel 20 takes place.

Referring now to FIGS. 3 and 4, the operation of the ball release assembly will now be discussed. The means to rotate the flywheel 20, which consists basically of the motor 48 and associated shafting, also drives the ball release assembly by means of step down gearing. Thus, the main gear 52 rotates a large diameter gearing 62 which is integral with small diameter gearing 64. The gearing 64 rotates large diameter gearing 66, which is integral with small diameter gearing 68, which rotates large diameter gearing 70, which is integral with small diameter gearing 72, which rotates the drive gear 74 shafted via shaft 76 to drive cam 40, which rotates as shown by arrow 78 because it is mounted to the rotating shaft 76 together with gear 74. The drive cam 40, as it rotates, intermittently depresses arm 80 which pivots about its lateral pivot mounting 82 to the orientation shown in phantom outline (FIG. 4). The arm 80 extends via connected members 82 and 84 to the pivoted timing arm 22 of the ball release assembly. As arm 80 is depressed by drive cam 40, spring 86 is stretched and elongated and put under tension, while concomitantly the free end 88 of member 84 moves downwards as shown in phantom outline. Since the timing arm 22 is biased by a spring 90, it concomitantly assumes the disposition shown in phantom outline, which corresponds to FIG. 2A, the full outline of timing arm 22 and members 84, 82 and 80 corresponding to FIGS. 2B and 2C. Thus, the ball release assembly entails the provision of the pivoted timing arm 22 which is pivoted at regular intervals by the drive cam 40 which is rotated on axle 76 by means of step down gearing as described supra, so that the means to rotate the flywheel (motor 48) also drives the ball release assembly.

Referring now in particular to FIGS. 2A, 2B and 2C, a generally frusto-conical or cylindrical guide chute 92 is mounted above the flywheel 20. As shown, the game balls 10 are passed sequentially by the rotating flywheel 20 into the guide chute 92, see especially FIG. 2B where the game ball 10' has been propelled as shown by arrow 36 upwards and away from the loading chute 14 and into the guide chute 92 by the flywheel 20.

A stationary, flexible and resiliently deformable brake pad generally designated as 94 is mounted in the guide chute 92 above the flywheel 20, and as shown, the pad 94 is spaced from the flywheel 20 at a distance less than the diameter of the game ball 10', so that a yieldable constriction 96 (FIGS. 2A, 2C) is provided in the path of travel of the game balls 10 in the guide chute 92. Thus, the game ball 10' released by the ball release assembly (pivoted timing arm 22) from the loading chute 14 first engages the rotating flywheel (FIG. 2A) which moves the game ball 10' against the pad 94 (FIG. 2B). The pad 94, as shown in FIG. 2B, temporarily holds fast the top of the game ball 10' while the bottom of the game ball 10' remains in contact with the rotating flywheel 20. The flywheel 20 thus pulls the game ball 10' past the constriction 96, as shown in FIG. 2C, by squeezing the flexible and resiliently deformable pad 94 and the flywheel surface of layer 42 of the flywheel 20. Thus, a backspin as designated by arrow 98 is imparted to the game ball 10'. Concomitantly, and when once free of the constriction as shown in FIG. 2C, the flywheel 20 throws the game ball 10' out of the guide chute. It is clearly apparent from FIGS. 2B and 2C that the backspin (arrow 98) is of an opposite sense of rotation to that of the flywheel 20 (arrow 38). Thus as shown, the flywheel 20 is rotating clockwise and the ball 10' is spinning counterclockwise.

The specifics of a preferred embodiment of the brake pad 94, as shown, will now be discussed. The flexible and resiliently deformable brake pad 94 is preferably composed of a natural or synthetic rubber, e.g. neoprene or buna, or of a suitable plastic such as polyvinyl chloride, polyethylene, polypropylene, or polyurethane. The pad 94 is general has a curved or rounded surface to facilitate ingress and egress of the game balls 10 into and out of the guide chute 92. In particular, in this preferred embodiment of the invention, the pad 94 has an abutment portion 100 which extends directly into the path of travel of the game balls 10; the abutment portion 100 forms the constriction 96. The pad 94 also has an upstream flared portion 102 which, as shown, diverges outwardly from the abutment portion 100 in upstream direction to facilitate presentation of each game ball 10 to the abutment portion 100 (see FIG. 2B). Finally, the pad 94 has a downstream tapered portion 104 which diverges outwardly from the abutment portion 100 in downstream direction, to facilitate expulsion of each game ball 10 away from the abutment portion 100 as shown in FIG. 2C.

In addition, the brake pad 94 is mounted to the guide chute 92 by means which allow interchangeable mounting of the brake pad 94 on the inner surface of the guide chute 92. This interchangeable mounting means, in this embodiment of the invention, is characterized by the provision of a mounting plate 106 generally composed of rigid plastic, on which the brake pad 94 itself is mounted. The plate 106 is held to the inner surface of the guide chute 92 by two removable screws 108 and 110, with an intermediate gasket 112 usually composed of resilient material, e.g. natural or synthetic rubber which is somewhat stiffer or harder than pad 94, also being provided. The interchangeable mounting means as described is accessible from the exterior of the guide chute, to permit ready access thereto, for exchanging a used and worn down pad 94 for a fresh one.

The mounting of the guide chute 92 is preferably adjustable, so that, as shown in FIG. 5, the angle of inclination of the guide chute 92 relative to the horizontal is adjustable about a pivoted support axis. Thus, as best seen in FIGS. 1, 3 and 5, the angle of inclination of the guide chute 92 in this embodiment of the invention is adjusted by a linear rack and pinion gearing assembly consisting of rack 114 and pinion gearing 116. The rack 114 is attached to the guide chute 92, and as shown in FIG. 5, the rack 114 has a circular curvature about a center axis 118 coincident with the pivoted axis of the guide chute 92. FIG. 3 shows a suitable pivoted mounting of the guide chute 92 on coaxial opposed axles 120 and 122 which are mounted, respectively, in journals 124 and 126. Suitable means are provided to at least partially rotate the pinion gearing 116 by manipulation; thus as seen in FIG. 3, a knob 128 for manual adjustment of the angle of inclination of guide chute 92 is connected via shaft 130 to the pinion 116. As shown in FIG. 5, manual partial rotation of the knob 128 rotates the pinion gear 116 in the direction of arrow 132 to displace the rack 114, as shown by the phantom outline in FIG. 5, so that the guide chute 92 is concomitantly displaced (as also shown by the phantom outline), so that the game balls 10 may be expelled somewhat upwardly from the horizontal (phantom arrows 134), rather than generally horizontally as shown by the arrow 136.

It thus will be seen that there is provided an automatic ball pitching machine which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. An apparatus for propelling spherical game balls sequentially along a path, said apparatus comprising:
(a) an inclined gravity-feed loading chute;
(b) means to load game balls into said loading chute;
(c) a flywheel adjacent the lower end of said loading chute, said flywheel having a flexible and resiliently deformable outer surface on its circumference;
(d) means to rotate said flywheel at high speed;
(e) a ball release assembly adjacent the lower end of said loading chute, to feed said game balls sequentially to said flywheel;
(f) a guide chute extending downstream of the path and being mounted above said flywheel, said guide chite having an upstream open end and a downstream open end, so that the game balls are passed sequentially by the rotating flywheel through the upstream open end into said guide chute and thereupon through the downstream open end; and
(g) a stationary, flexible and resiliently deformable brake pad mounted in said guide chute between the open ends thereof and above said flywheel, said guide chute extending beyond said brake pad, said brake pad being spaced from said flywheel at a distance less than the diameter of said game balls, so that a constriction in the path of travel of the game balls is provided in the guide chute, and so that each game ball released by said release assembly from said loading chute first engages said rotating flywheel which moves the game ball against said pad, which temporarily holds fast the top of said game ball while the bottom of said game ball remains in contact with the rotating flywheel, which pulls the game ball past the constriction by squeezing the flexible and resiliently deformable pad and flywheel surface, so that once free of the constriction, said flywheel propels the free game ball past said brake pad along said guide chute for a distance sufficient to guide the game ball along a predetermined trajectory, and thereupon said flywheel throws said game ball out of the downstream open end of said guide chute and comcomitantly imparts a backspin on said game ball, the backspin being of an opposite sense of rotation to that of said flywheel.

2. The apparatus of claim 1 in which the flywheel rotates clockwise, and the backspin imparted to the game ball is counterclockwise.

3. The apparatus of claim 1 in which the flywheel rotates counterclockwise, and the backspin imparted to the game ball is clockwise.

4. The apparatus of claim 1 in which the game ball is selected from the group consisting of a baseball, a handball, a soccer ball, a softball, a hollow or solid rubber ball, a tennis ball and a golf ball.

5. The apparatus of claim 1 in which the ball release assembly comprises a pivoted timing arm which is pivoted at regular intervals by a drive cam.

6. The apparatus of claim 1 in which the angle of inclination of the guide chute relative to the horizontal is adjustable about a pivoted support axis.

7. The apparatus of claim 6 in which the angle of inclination of the guide chute is adjusted by a linear rack and pinion gearing, said rack being attached to the guide chute and having a circular curvature about a center axis coincident with the pivoted axis of the guide chute; together with means to rotate said pinion gearing.

8. The apparatus of claim 1 in which the flexible and resiliently deformable brake pad, and the flexible and resiliently deformable outer surface of the flywheel, are each composed of natural or synthetic rubber, or plastic.

9. The apparatus of claim 8 in which the synthetic rubber is selected from the group consisting of neoprene and buna.

10. The apparatus of claim 8 in which the plastic is selected from the group consisting of polyvinyl chloride, polyethylene, polypropylene, and polyurethane.

11. The apparatus of claim 1 in which the pad has a curved or rounded surface.

12. The apparatus of claim 1 and further comprising means for interchangeably mounting the brake pad on the inner surface of the guide chute, said interchangeably mounting means being accessible from the exterior of the guide chute to permit ready access thereto for exchanging a used pad for a fresh one.

13. The apparatus of claim 1 wherein the outer surface of said flywheel has a shallow circumferential centering trough for receivably guiding each game ball in a predetermined controlled manner along the travel path and into the guide chute.

14. The apparatus of claim 1 wherein the means to rotate the flywheel also drives the ball release assembly by means of step down gearing.

15. An apparatus for propelling spherical game balls sequentially, said apparatus comprising:
(a) an inclined gravity-feed loading chute;
(b) means to load game balls into said loading chute;
(c) a flywheel adjacent the lower end of said loading chute, said flywheel having a flexible and resiliently deformable outer surface on its circumference;
(d) means to rotate said flywheel at high speed;
(e) a ball release assembly adjacent the lower end of said loading chute, to feed said game balls sequentially to said flywheel;

(f) a guide chute mounted above said flywheel, so that the game balls are passed sequentially by the rotating flywheel into said guide chute; and (g) a stationary, flexible and resiliently deformable brake pad, said pad being mounted in said guide chute above said flywheel and spaced from said flywheel at a distance less than the diameter of said game balls, so that a constriction in the path of travel of the game balls is provided in the guide chute, said pad having an abutment portion extending into the path of travel of the game balls to form the constriction, an upstream flared portion which diverges outwardly from said abutment portion in upstream direction to facilitate presentation of each game ball to said abutment portion, and a downstream tapered portion which diverges outwardly from said abutment portion in downstream direction to facilitate expulsion of each game ball away from said abutment portion, and so that each game ball released by said release assembly from said loading chute first engages said rotating flywheel which moves the game ball against said pad, which temporarily holds fast the top of said game ball while the bottom of said game ball remains in contact with the rotating flywheel, which pulls the game ball past the constriction by squeezing the flexible and resiliently deformable pad and flywheel surface, so that once free of the constriction, said flywheel throws said game ball out of said guide chute and comcomitantly imparts a backspin on said game ball, the backspin being of an opposite sense of rotation to that of said flywheel.

16. An apparatus for propelling spherical game balls sequentially, said apparatus comprising;

(a) an inclined gravity-feed loading chute;

(b) means to load game balls into said loading chute;

(c) a flywheel adjacent the lower end of said loading chute, said flywheel having a flexible and resiliently deformable outer surface on its circumference, said flywheel having a generally circular core portion and an outer flexible and resiliently deformable layer portion which circumferentially surrounds the core portion, said core portion being of greater mass and weight than said outer layer portion;

(d) means to rotate said flywheel at high speed;

(e) a ball release assembly adjacent the lower end of said loading chute, to feed said game balls sequentially to said flywheel;

(f) a guide chute mounted above said flywheel, so that the game balls are passed sequentially by the rotating flywheel into said guide chute; and (g) a stationary, flexible and resiliently deformable brake pad, said pad being mounted in said guide chute above said flywheel and spaced from said flywheel at a distance less than the diameter of said game balls, so that a constriction in the path of travel of the game balls is provided in the guide chute, and so that each game ball released by said release assembly from said loading chute first engages said rotating flywheel which moves the game ball against said pad, which temporarily holds fast the top of said game ball while the bottom of said game ball remains in contact with the rotating flywheel, which pulls the game ball past the constriction by squeezing the flexible and resiliently deformable pad and flywheel surface, so that once free of the constriction, said flywheel throws said game ball out of said guide chute and comcomitantly imparts a backspin on said game ball, the backspin being of an opposite sense of rotation to that of said flywheel.

* * * * *